US006489715B1

(12) United States Patent
Shen et al.

(10) Patent No.: US 6,489,715 B1
(45) Date of Patent: Dec. 3, 2002

(54) LUMINOUS FACEPLATE OF COLOR PROJECTION CATHODE RAY TUBE AND SUBSTRATE FOR MANUFACTURING THE SAME

(75) Inventors: Dezhong Shen; Cunxin Huang; Zaixue Peng; Deming Lui; Muyun Lei; Zhiyang Zhang, all of Beijing (CN)

(73) Assignee: Research Institute of Synthetic Crystals, Beijing (CN)

( * ) Notice: Subject to any disclaimer, the term of this patent is extended or adjusted under 35 U.S.C. 154(b) by 0 days.

(21) Appl. No.: 09/331,995

(22) PCT Filed: Dec. 30, 1997

(86) PCT No.: PCT/CN97/00152

§ 371 (c)(1),
(2), (4) Date: Oct. 7, 1999

(87) PCT Pub. No.: WO98/29894

PCT Pub. Date: Jul. 9, 1998

(30) Foreign Application Priority Data

Dec. 30, 1996 (CN) ..... 96114173 A

(51) Int. Cl.[7] ..... H01J 29/86
(52) U.S. Cl. ..... 313/463; 313/473; 313/467

(58) Field of Search ..... 313/473, 463, 313/467; 156/600, 647, 648

(56) References Cited

U.S. PATENT DOCUMENTS 3,974,249 A 8/1976 Roy et al. ..... 264/65
4,514,756 A * 4/1985 Blank et al. ..... 358/66

FOREIGN PATENT DOCUMENTS

CN 1134034 A 10/1996
JP 8-180818 7/1996

* cited by examiner

*Primary Examiner*—Vip Patel
*Assistant Examiner*—Ken A Berck
(74) *Attorney, Agent, or Firm*—Westman, Champlin & Kelly, P.A.

(57) ABSTRACT

The present invention relates to a substrate of a luminous faceplate of a color projection cathode ray tube and a luminous faceplate which is composed of this substrate. The substrate consists of transparent polycrystalline material, and the luminous faceplate comprises a transparent polycrystal substrate and a luminous layer which is formed thereon. The luminous faceplate using the substrate of the present invention has an advantage over the prior art in the volume of a product, operating power, manufacturing cost, and resolution and so on. Thus, it is widely used in the field of color projection TV, advertisement display and so on.

7 Claims, 2 Drawing Sheets

LUMINOUS FACEPLATE OF COLOR PROJECTION CATHODE RAY TUBE AND SUBSTRATE FOR MANUFACTURING THE SAME

FIELD OF INVENTION

The present invention relates to a photelectric display apparatus, and more particularly to a luminous faceplate of the color projection cathode ray tube (CRT) and the substrate for manufacturing the same.

BACKGROUND OF THE INVENTION

One of the apparatus for displaying pictures and words on large screen is color projection television. The most critical parts of the projection apparatus are three projection CRT's, which projects red, green and blue light, respectively. Usually, this kind of the luminous faceplate of projection CRT is formed by depositing powder phosphors on a glass substrate. The glass substrate has a very low thermal conductivity, and the heat conducting performance of the luminous powder is also not good, resulting in that the glass-powder luminous faceplate could not work at relatively high operating power. Furthermore, the luminous powder will be decomposed at a power density higher than $1W/cm^2$; and the luminous powder will be melted under the power density of $5W/cm^2$. On the other hand, increasing area of the electron-beam spot in order to decrease the power density would adversely impair the resolution of a CRT. Besides, there is so-called Coulomb Degradation existing in the luminous powder: when the electron dosage reaches 150 coulombs/ $cm^2$, the initial intensity of the luminous powder will decrease to a value of 50% of the initial intensity. Even in the preferred operation environment, the lifetime of this kind of CRT's under high luminance is only 1000 hours.

In order to overcome the above-mentioned weaknesses of the glass-powder luminous faceplate, a new kind of the color projection luminous faceplate has been developed. This kind of luminous faceplate is composed by epitaxially growing a rare-earth element doped yttrium aluminum garnet (YAG) luminous layer having a high thermal conductivity on a YAG single crystal substrate, which has very high thermal conductivity. Because of the good thermal contact between an epitaxial luminous layer and a heat-conductive substrate, this kind of luminous faceplate can work under a high operating power which would destroy the glass-powder luminous layer. Thus, the color projection CRT's made of this kind of epitaxial luminous faceplate having highly thermal conductive can operate under a high power, and has very high resolution and very short relaxation time. It further has the advantages of corrosion resistance and aging-resistance.

However, it is very difficult to bond a YAG single crystal wafer and a CRT body together because of the relatively high difference between their thermal expansion coefficients. YAG single crystal has a refractive index of 1.84, the corresponding light output fraction from the epitaxial faceplate in only 16%, thus the brightness is not high enough. These two factors result in that the projection CRT made of epitaxial luminous faceplate on the YAG single crystal can not be practically used.

Hereafter, Chinese patent No. 95111324.0 discloses a technique for solving the problem for hermetically bonding a substrate of single crystal YAG to a tube body, and increasing the brightness of the single crystal YAG luminous faceplate. By means of this technique, a color projection CRTs having a YAG single crystal luminous faceplate with high definition and high brightness was successfully fabricated, the resolution of which reached 2000 lines and brightness of which reached $10^5$ $cd/m^2$.

However, the growth rate of the YAG single crystal used as the substrate of the luminous faceplate is low, while the high temperature puller for preparing the crystals is very expensive and consumes huge electrical power. Thus, using YAG single crystal as the substrate of luminous faceplate is unfavorable for mass production of the luminous faceplate and for reducing of cost. In addition, since size of the faceplate is limited by the size of the single crystal ingot (at present, it can only be made to 4 inches), using YAG single crystal as the substrate of luminous faceplate is therefore unfavorable for increasing the operation power of the CRTs. It is therefore needed to find a material for luminous faceplate of color projection CRTs, which can satisfy with requirements for performance specifications of the luminous faceplate and be mass-produced at low cost as well.

In the prior art, transparent polycrystal body (TPB) for various transmission windows has been investigating for many years. The technology for producing TPB is relatively easy, throughput is high, production cost is relatively low, and particularly some TPBs have very high mechanical strength and excellent corrosion-resistance. Therefore, it is widely used in many especial fields such as sensing tip cover of the missile, monitor window of high temperature furnace, lens for detecting radiation in a well, jet nuzzle, and so on. The inventors of the present invention tried to use TPB in the photo-displaying field, and found that once the TPB satisfies with certain requirements on physical and chemical characteristics such as transmittance, thermal conductivity, mechanical strength, and corrosion-resistance, it can be used to fabricate the luminous faceplate of CRTs.

According to the mature technology for fabricating TPB, TPB ingot is formed by means of one-step vacuum hot press sintering or two-steps vacuum sintering, and thermal isostatic pressing. The ingot is cut into desired shape and size, then is ground and polished to desired smoothness, so that the substrate of TPB is formed. A layer of luminous film is formed on one of the substrate surfaces, whereby luminous faceplate suitable to be used in projection CRTs is formed.

The size limit of the substrate of TPBs mainly determined by the size of the furnace chamber of hot press or a hot isostatic press. There is no problem in fabrication of TPB having a diameter larger than 200 mm and a thickness larger than 5 mm. The size of the substrate of TPB may be much larger than that of the single crystal substrate, its processing is also much faster.

The substrate is usually in plane circle shape. The inventors of the present invention further found when a large screen luminous faceplate used under high power is fabricated, it has several advantages to use a substrate of TPB in the shape of thickness-equal spherical face. That is, it can not only increase the mechanical strength of the faceplate, and make the luminous intensity of the faceplate more uniform, but also increase the light output of the epitaxial luminous faceplate.

SUMMARY OF THE INVENTION

The object of the present invention is to provide a luminous faceplate of color projection CRTs capable of operating under high power, having low fabricating cost, and easy to be mass-produced.

In order to achieve the object of the present invention, a luminous faceplate used in color projection CRTs is provided, which includes a substrate and luminous layer connected to said substrate, wherein said substrate is consisted of TPB.

Using TPB as material of a luminous faceplate of the color projection CRT has many advantages compared with using a single crystal substrate. For instance, the size of a transparent luminous faceplate can be made much larger than available largest size of the single crystal luminous faceplate; the mechanical strength of TPB is higher than that of the single crystal; TPB is isotropical and easy to be hermetically soldered with CRT body; the production cost (especially in case of forming luminous faceplate in a non-plane) is relatively low, and the produce period is shorter than that of single crystal preparation. Therefore, TPB is suitable for mass production. Since YAG single crystal substrate is formed by cutting single crystal ingot, it is very difficult to make the single crystal substrate to be curve shape, and the material will be seriously wasted. For TPB, however, the only thing has to do is changing the molder from plane to corresponding curve shape. This is a further advantage of TPB superior to the single crystal material in the case of forming luminous faceplate of high power CRTs.

Many kinds of TPBs have extremely high thermal conductivity. Therefore, compared with luminous faceplate of a glass substrate, the luminous faceplate formed by using TPB as the substrate can work at much higher operating power. With the same requirements of brightness and resolution, the color projection CRT formed by using a TPB luminous faceplate of 3 inches diameter can have the same effect as the color projection CRT formed by using a glass luminous faceplate of 7 inches diameter does. Owing to the reduction of the diameter of the luminous faceplate, the size of the overall projection lens is also reduced. This is not only able to reduce the volume of the projection television, but also can reduce the cost. Just because this, although the price of TPB is higher than that of glass, the cost of projection head (projection CRT plus projection lens) is lower than that of the projection head formed by glass faceplate. In addition, since the mechanical strength of TPB is higher than that of glass, and the corrosion-resistance of it is high, the thickness of the substrate can be made thinner than that of glass for fabricating the luminous faceplate having the same size. This can not only reduce the absorption of incident light, but also reduce the image distortion resultant from the thickness, whereby increase the resolution.

Hereinafter, the present invention will be briefly described in conjunction with the accompanying drawings, wherein,

DETAILED DESCRIPTION

Unlike the application that TPB is used as transmission windows, if TPB is used as a substrate of luminous faceplate, the substrate is bonded together with the light emission layer as a whole to function.

Figure 1:
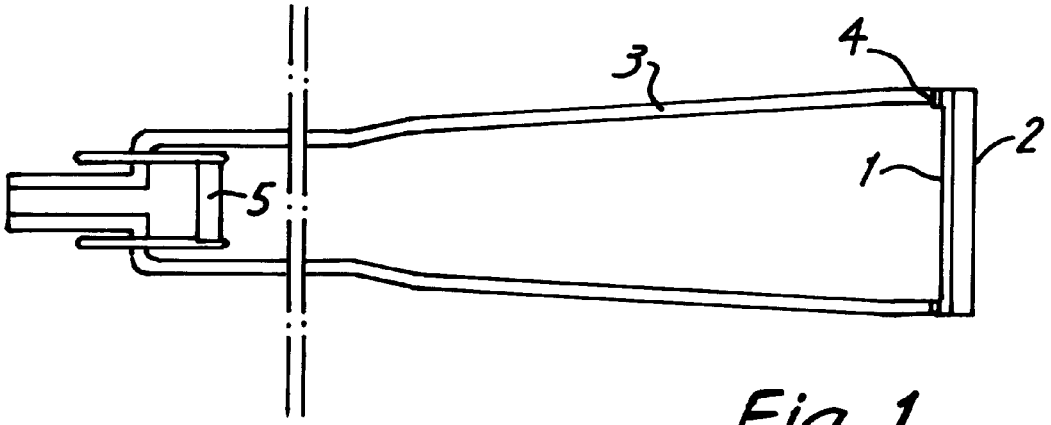
FIG. 1 is a schematic drawing of the structure of the color projection CRT formed by the TPB luminous faceplate of the present invention.

As shown in FIG. 1, a light emission layer 1 is formed on one of the side surfaces of the substrate of TPB 2 to form a luminous faceplate. The faceplate is hermetically soldered to the case of CRT 3 with a solder 4 in order to evacuate the tube into vacuum. For the purpose of being able to carry out soldering, the size of the substrate should be larger than the aperture for light-passing of CRT, the thickness of it should be larger than 1 mm. The electron beam emitted from the cathode 5 strikes on the light emission layer 1, causing it to emit lights of desired color. These lights project on the screen though the substrate of TPB 2 for displaying.

Various TPBs and the methods for preparing the same have been known. The inventors found that the luminous faceplates of color projection CRT formed by using TPB which satisfy with following requirements have the best effect.

1. In visible spectrum, particularly in red, green and blue (the three basic colors) regions, the transmittances should be as high as possible. In the range of 0.4–0.8 micrometer wavelength, the transmittances should be not less than 80%.

2. The thermal conductivity should be high. Usually, it should not be lower than 0.05W/cmK, so that the luminous faceplates can operate under high power.

3. The coefficient of thermal expansion should be able to match with that of body material of CRT, in order to facilitate the hermetic soldering;

4. The mechanical strength should be high. The flexural strength should not be lower than 100 Mpa, so that it can bear negative pressure;

5. The corrosion-resistance should be good. The transmittance should not be lower than 90% of the original value after being exposed to UV light or X-ray or being soaked in water for 24 hours;

6. The hardness should be high and the refractive index should be as small as possible.

The requirement for high hardness is to avoid scratch damage to the surface of the faceplate during operation, while the requirement for low refractive index is to increase the luminous flux emitted though the faceplate. The smaller the refractive index of the substrate of TPB is, the larger the total reflection critical angle (at which total reflection occurs) on an emitting surface of the substrate for the light emitted from expitaxial luminous layer is, thus the larger the output light flux is.

There are many kinds of TPB. The currently known TPBs which are satisfied with the above-mentioned requirements are mainly those in cubic crystalline system, including TPBs such as $MgAl_2O_4$ (MAO), $Y_3Al_5O_{12}$ (YAG), $Y_2O_3$ and $5AlN.9Al_2O_3$ (ALON). Some main properties of the TPBs such as MAO, YAG, $Y_2O_3$, ALON are listed in table 1.

TABLE 1

Some main properties of the TPBs of MAO, YAG, $Y_2O_3$ and ALON

| Properties | MAO | YAG | $Y_2O_3$ | ALON |
|---|---|---|---|---|
| Crystalline system | cubic | cubic | cubic | cubic |
| Lattice constant (A) | a = 8.0831 | a = 12.005 | a = 10.603 | |
| Refractive index | 1.719 (λ = 546 nm) | 1.84 (λ = 530 nm) | 1.77 (λ = 589 nm) | 1.74 (λ = 630 nm) |
| Coefficient of thermal expansion ($10^{-6}$/° C.) | 7.0 (25–1000° C.) | 7.7 (25–1200° C.) | 6.6 (20–50° C.) | 7 (30–100° C.) |

TABLE 1-continued

| Some main properties of the TPBs of MAO, YAG, $Y_2O_3$ and ALON | | | | |
|---|---|---|---|---|
| Properties | MAO | YAG | $Y_2O_3$ | ALON |
| Transparent range ($\mu$m) | 0.2–6 5 | 0.28–5.3 | 0.25–7 | 0.29–4.8 |
| No coating Transmittance for 0.4–0.6 $\mu$m (%) | >80 (2 mm thickness) | >80 (2 mm thickness) | ~80 | ~80 (2.6 mm thickness) |
| Thermal conductivity (W/cm.K) | 0.15 | 0.11 | 0.9 | 0.12 |
| Flexural strength (MPa) | 122 | | 110 | 300 |
| Hardness | 8.5 Mohs | 8.5 Mohs | 7.2 Mohs | 1912 kg/mm$^3$ |
| Density (g/cm$^2$) | 3.58 | 4.55 | 5.03 | 3.68 |
| Melt point (° C.) | 2135 | 1970 | 2688 | 2140 |

It can be seen from table 1 that the basic properties of TPB of all four kinks of cubic crystalline systems are satisfied with the requirements for forming luminous faceplate. Comparably, however, the MAO TPB is better than others because the refractive index of MAO is smaller. In particular, YAG has a refractive index of n=1.84, a corresponding total reflection critical angle of 33 degree, and a corresponding light output fraction of the epitaxial luminous faceplate of 16%. Meanwhile MAO has a refractive index of n=1.719, a corresponding total reflection critical angle of 35.6 degree and a corresponding light output fraction of 19%. This means that the light output of the epitaxial luminous faceplate made of TPB MAO is about 20% higher than that of the epitaxial luminous faceplate made from YAG TPB. Further, the transmittance within short spectrum range for the MAO TPB is higher than that for YAG TPB. Moreover, the price of magnesium is only one percent of that of yttrium, and the density of MAO is also smaller. in view of the cost, using MAO is more worthwhile than using YAG. Although the thermal conductivity of $Y_2O_3$ is higher, and the refractive index of ALON is smaller, their transmittances are both somewhat worse than that of MAO and YAG, which will impair the light flux.

In view of strength, the thickness of the TPB should be higher than 1 mm. The resultant substrate of TPB is ground into a desired size and thickness, the two surfaces are polished to a scratch-dig size of less than 20—20. A luminous layer of 1–20 $\mu$m is then formed on one of the polished surfaces, whereby a piece of TPB luminous faceplate is formed.

There are several methods for forming a layer of luminous film on TPB substrate, such as ion beam epitaxy, RF sputtering, pulse laser deposition, sol-gel, liquid phase epitaxy and powder deposition etc.

A kind of luminous material which possesses high thermal conductivity is rare-earth element doped YAG. A luminous faceplate having high thermal conductivity and high resolution can be formed by growing a doped YAG luminous epitaxial layer on a surface of the YAG substrate of TPB. The epitaxial layer is formed by a homogeneous epitaxy because the lattice constants of both the epitaxial layer and the substrate are nearly the same. When a YAG layer is formed on a MAO luminous faceplate as a luminous layer, there is a problem of lattice match associated with it. In this situation (heterogeneous epitaxy), a transition layer is needed between the substrate and the epitaxial layer, which is made of a material having a lattice constant between that of them. The methods mentioned above can be used to form this transition layer.

The method conventionally used to form a luminous faceplate of CRTs, i.e., the method for depositing luminous powder on an inner surface of a glass envelope, can be also used to form the TPB luminous faceplate of the present invention, and may obtain a better application effect. The high thermal conductivity property of the TPB such as MAO and YAG etc., results in a significant improvement of the performance characteristics of the projection CRTs formed by this kind of luminous faceplate substrate having a high thermal conductivity. They can work under a operating power much higher than that for glass-powder luminous faceplate. A CRT made of TPB-powder luminous faceplate of 3 inches diameter can reach the same brightness and resolution as a CRT made of glass-powder luminous faceplate of 7 inches diameter.

For a CRT working under a low power, the diameter of luminous faceplate does not need too large (3 inches usually). The faceplate can be formed in a shape of parallel plane, having a thickness of about 1.5 mm. If a CRT working under high power is to be fabricated, the diameter of the faceplate should be relatively large, which is usually larger than 5 inch. In this case, if a plane shaped TPB is still used to form the luminous faceplate, it is then necessary to increase the thickness of the faceplate in order to enhance the ability of bearing negative pressure under large span. However, as the thickness increases, absorption will increase correspondingly. This will certainly result in a decrease of light flux. In order to overcome this contradictory, the faceplate may be shaped in a positive camber form protruding towards the outside of CRT.

There are several schemes for designing the camber shape of the faceplate. In an embodiment of the present invention, a thickness-equal spherical face type of faceplate is used. The radius of curvature of this thickness equal spherical face type of faceplate in the luminous layer side is the distance from the electron beam deflection center to the center of the luminous layer of the faceplate.

From the above, it can be seen that the mechanical strength of the faceplate in bearing a negative pressure is increased and the luminous intensity of the faceplate is more uniform than the prior art by using thickness-equal spherical face. Besides the above-mentioned two advantages, the thickness-equal spherical face type of TPB luminous faceplate further has another advantage: it can increase the total reflection critical angle of the faceplate substrate, thus the output light flux through the faceplate substrate is increased. As for the spherical TPB used as light transmission window, this advantage would not occur.

Figure 2:
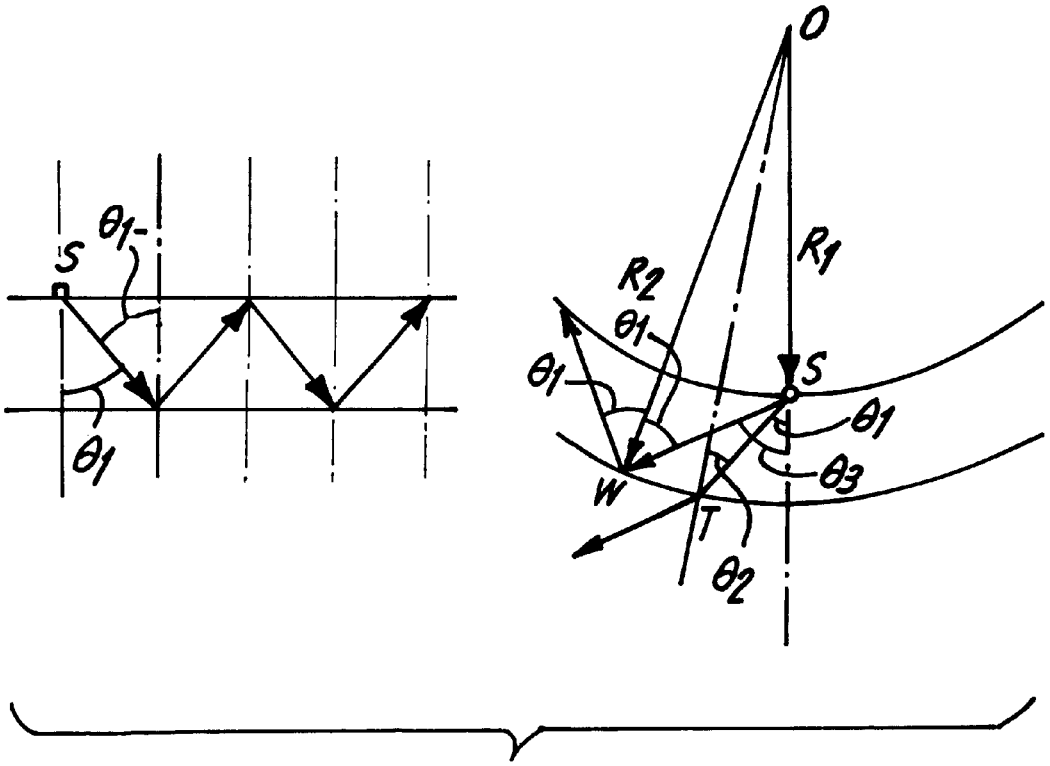
FIG. 2 is a schematic drawing for showing the principle that the critical angle of total reflection is enhanced by the thickness equal spherical face type epitaxial luminous faceplate of the present invention.

FIG. 2 shows the comparison between the light output through the luminous faceplates having two different shapes. FIG. 2(A) shows a parallel plane type of faceplate, and FIG. 2(B) shows a thickness-equal spherical face type of faceplate. The point O in the figure is the electron beam deflection center, and point S is a luminous point on the epitaxial luminous layer. For the case of FIG. 2(A), when the emission angle of the light emitted from point S is larger than the total reflection critical angle $\theta_1$ of said TPB, the total reflection takes place, thus the light is not able to emit from the faceplate. On the other hand, for the case of FIG. 2(B), when the light emitted from point S at the total reflection critical angle $\theta_1$ arrives point T on the outside surface of the faceplate, some light still emits from point T because the incident angle $\theta_2<\theta_1$ at point T. Only if the emission angle of the light emitted from point S is larger than $\theta_3$, at emission point W the total reflection takes place. Assume the radiuses of curvature for inner and outside spherical surface are $R_1$ and $R_2$, respectively, the $\theta_3$ can be calculated by following equation:

$$\mathrm{Sin}\theta_3=\mathrm{Sin}\theta_1\cdot R_2/R_1$$

Because $R_2$ is always larger than $R_1$, so $R_2/R_1>1$, thus $\theta_3>\theta_1$. It can be seen that the total reflection critical angle of thickness equal spherical face of type epitaxial luminous faceplate is extended from $\theta_1$ of the plane face type of luminous faceplate to $\theta_3$. The light flux passing through the faceplate is therefore also increased.

Embodiment 1

Figure 4:
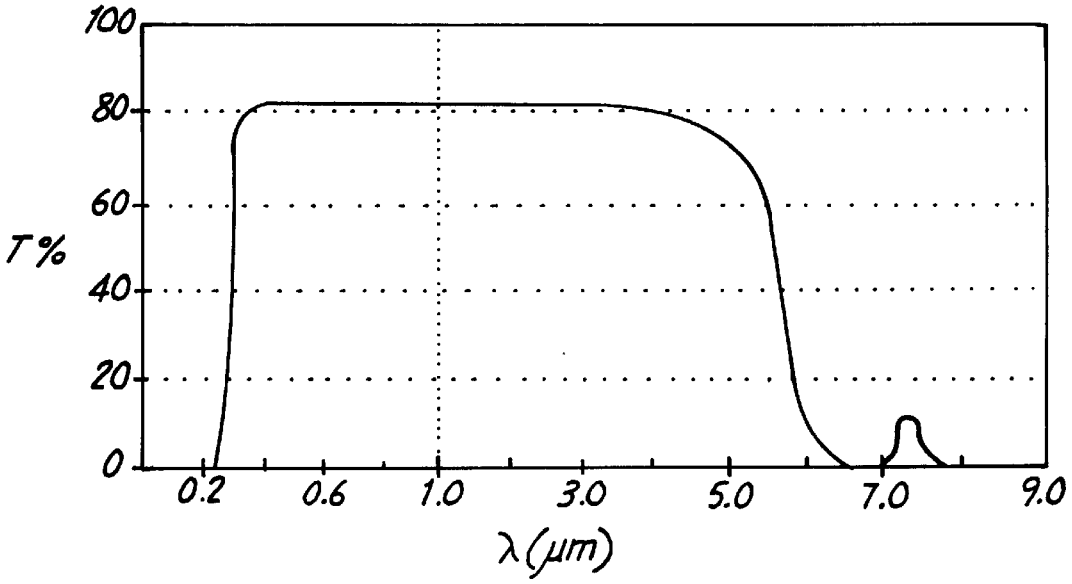
FIG. 4 is a transmittance curve of the $MgAl_2O_4$ TPB used as luminous faceplate of the present invention.

90 g of $MgAl_2O_4$ powder having a purity of 4N is prepared according to the method disclosed by Chinese patent No. CN1127734A. Ager adding 1.4–1.8 g of LiF, the mixed powder is ground. Then the powder is pressed into a plane type TPB wafer having a diameter of 54 mm and thickness of 2 mm by one-step process in a vacuum heat press furnace. Both sides of this TPB wafer are finely polished, resulting in a wafer having a final thickness of 1.8 mm. A powder luminous layer for luminous green light is prepared on one of the surfaces of the wafer by powder deposition. Thus a piece of luminous faceplate made of powder light-emitter is obtained, which uses a high thermal conductivity MAO TPB was its substrate. The test results show that the green light transmittance is higher than 80% (see FIG. 4), the resolution is higher than 1300 lines. Its brightness can reach $10^5$ cd/cm$^2$, which is superior to those of the glass-powder luminous faceplate of 5 inches diameter.

Embodiment 2

Figure 3:
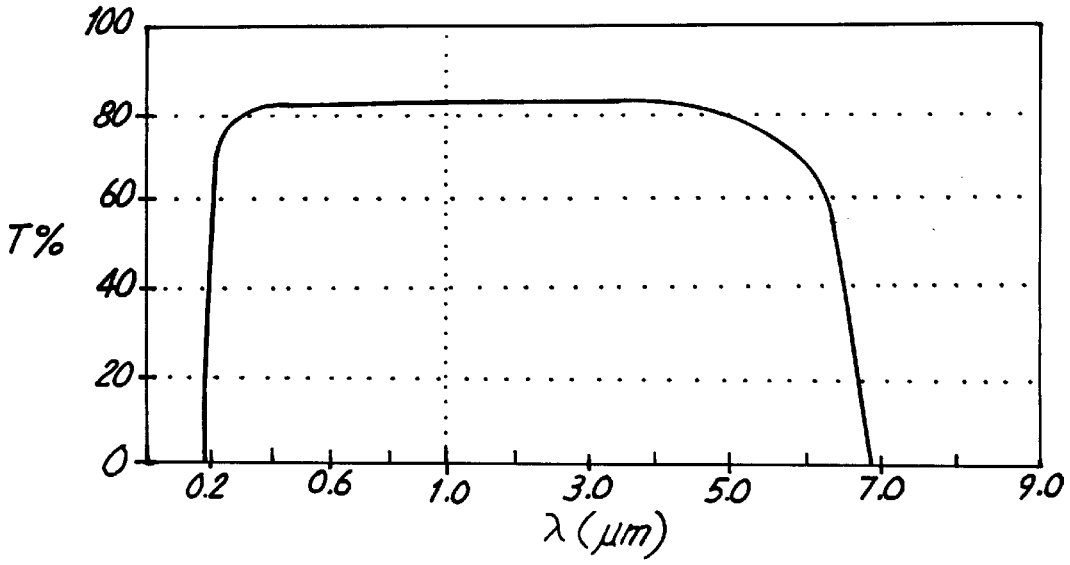
FIG. 3 is a transmittance curve of the $Y_3Al_5O_{12}$ TPB used by luminous faceplate of the present invention.

After the reagents of $Y_2O_3$ and $Al_2O_3$ having spectral purity under the average particle size of submicron were homogeneously mixed in a molar ration of 3:5, the mixture is then loaded in a spherical graphite molder of 130 mm diameter. The upper convex molder has a radius of curvature of $R_1$=147 mm, while the lower concare molder has a radius of curvature $R_2$=151 mm. The mixture is cold pressed into a shape in a cold presser, and then sintered into an ingot with closed porosity at temperature of 1200° C. in a vacuum furnace. The ingot is then loaded in a hot isostatic press and formed into TPB under the condition of hydrogen pressure of 150–200 MPa and temperature of 1500–1800° C. Thus a spherical YAG TPB with thickness of t=151 mm–147 mm=4 mm is obtained after the temperature and the pressure were lowered. The both surfaces of the spherical YAG TPB are finely polished so that the $R_1$ and $R_2$ become 148 mm and 150 mm, respectively, i.e., the wafer thickness becomes 2 mm. A layer of high thermal conductivity luminous Ce: YAG having a thickness of 17 $\mu$m is epitaxially grown on the concave surface of the resultant TPB, thus forming a piece of thickness-equal spherical face type of epitaxial luminous faceplate which emits green light. The test results show that the faceplate has green light transmittance higher than 80% (see FIG. 3), resolution higher than 1400 lines, and output light flux increased by 0.57% compared with the parallel plane type of YAG TPB epitaxial luminous faceplate of the same thickness (2 mm).

Embodiment 3

The $Y_2O_3$ powder with a purity of 4N and the BeO powder are homogeneously mixed in weight ration of 99.2%: 0.8%. The mixture is then cold pressed into shape under a pressure of 3 ton/cm$^2$. The shaped mixture is then subjected to a sintering at 225° C. for 300 minutes in an environment of pure hydrogen having dew point of −35° C. and further subjected to another sintering at 1800° C. for 10 minutes in an environment of pure hydrogen having dew point of 0° C. The resultant sintered ingot is processed into wafer having a diameter of 76 mm and a thickness of 2 mm. After finely polishing of both sides of the wafer, a crystalline emission layer of $Ce:LaBe_2O_5$ with a thickness of 2 micrometers is deposited on one side of the wafer by pulse laser deposition. Thus a piece of $Y_2O_3$ TPB luminous faceplate, which emits blue light, is formed. Its blue light transmittance is about 80%, and the resolution is about 1300 lines.

Embodiment 4

ALON powder is composed by hot-carbon decomposition from $Al_2O_3$ in nitrogen atmosphere. After said ALON powder is ground for 16 hours in a ball grinder, the powder is subjected to isostatic pressing under a pressure of 2000 psi. Then the resultant ingot is loaded in a crucible made of boron nitride and subjected to a sintering at 1980° C. for 48 hours in a static nitrogen atmosphere (about 3 psig). The resultant TPB ingot of ALON is cut and finely polished into a wafer with a diameter of 76 mm and a thickness of 2 mm. A $Ce:Gd_3Al_5O_{12}$ luminous thin film of 10 micrometer thick is formed on one surface of the wafer by liquid phase epitaxy. Thus a piece of TPB luminous faceplate of ALON, which emits red light, is obtained with red light transmittance higher than 80%, and a resolution higher than 1300 lines. The price of ALON raw material is lower, while the mechanical strength of the formed TPB is higher, therefore, it is a highly promising material for luminous faceplate substrates.

Because the luminous faceplate of glass-powder can not work under high operating power, all of the luminous faceplate of glass-powder with a diameter less than 5 inches can not be used in projection CRT. In order to achieve a brightness of $10^5$ cd/cm$^2$ and a resolution of 1000 lines, the diameter of a glass-powder luminous faceplate must be larger than at least 7 inches. The present invention solves the problem in the prior art successively.

It is obvious that the embodiments described above are merely for illustrating of the present invention, they do not construct any limitation on the present invention.

What is claimed is:

1. A luminous faceplate used in a color projection cathode ray tube, comprising a substrate and a luminous layer bonded to the substrate, wherein said substrate is consisted of transparent polycrystal body in cubic crystalline system.

2. A luminous faceplate according to claim 1, wherein said transparent polycrystal body is one selected from the group consisted of $MgAl_2O_4$, $Y_3Al_5O_{12}$, $Y_2O_3$ and $5AlN.9Al_2O_3$.

3. A luminous faceplate according to claim 1 wherein said substrate is shaped into parallel plane or thickness equal spherical face.

4. A luminous faceplate according to claim 3, wherein the radius of curvature of said thickness-equal spherical face type of faceplate on the side of the luminous layer is equal to a distance from the center of said luminous layer to the electron beam deflection center of the cathode ray tube.

5. A luminous faceplate according to claim 2, wherein said substrate is shaped into parallel plane of thickness equal spherical face.

6. A luminous faceplate according to claim 1, wherein said type luminous layer is a polycrystal luminous layer which is epitaxially grown on said transparent polycrystal body or powdery luminous material which is directly coated on said transparent polycrystal body.

7. A luminous faceplate according to claim 1, wherein said transparent polycrystal body is formed by powder through one-step vacuum hot press sintering or two-steps vacuum sintering and thermal iso-static pressing.

* * * * *

UNITED STATES PATENT AND TRADEMARK OFFICE

CERTIFICATE OF CORRECTION

PATENT NO. : 6,489,715 B1
DATED : December 3, 2002
INVENTOR(S) : Shen et al.

It is certified that error appears in the above-identified patent and that said Letters Patent is hereby corrected as shown below:

Column 5,
Line 18, Table 1, after "1912" replace "$kg/mm^3$" with -- $kg/mm^2$ --.

Column 8,
Line 54, replace "$5AlN . 9Al_2O_3$" with -- $5AlN \cdot 9Al_2O_3$ --.
Line 67, after "said" delete "type".

Signed and Sealed this

Fourth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,489,715 B1
APPLICATION NO. : 09/331995
DATED : December 3, 2002
INVENTOR(S) : Shen et al.

It is certified that error appears in the above-identified patent and that said Letters Patent is hereby corrected as shown below:

Column 4,
Line 60, Table 1, replace "Lattice constant (A)" with -- Lattice constant (Å) --.
Line 64, Table 1, replace "(30-100°C)" with -- (30-1000°C) --.

Column 7,
Line 20, replace "Ager" with -- After --.

Column 8,
Line 64, replace "of" with -- or --.

Signed and Sealed this

Twenty-seventh Day of June, 2006

JON W. DUDAS
*Director of the United States Patent and Trademark Office*